US008353408B2

(12) United States Patent
Ito

(10) Patent No.: US 8,353,408 B2
(45) Date of Patent: Jan. 15, 2013

(54) CENTRIFUGAL AIR CLASSIFIER

(75) Inventor: Mitsuhiro Ito, Tokyo (JP)

(73) Assignee: Taiheiyo Cement Corporation, Tokyo (JP)

( * ) Notice: Subject to any disclaimer, the term of this patent is extended or adjusted under 35 U.S.C. 154(b) by 473 days.

(21) Appl. No.: 12/280,122

(22) PCT Filed: Feb. 24, 2006

(86) PCT No.: PCT/JP2006/304033
§ 371 (c)(1),
(2), (4) Date: Aug. 20, 2008

(87) PCT Pub. No.: WO2007/097042
PCT Pub. Date: Aug. 30, 2007

(65) Prior Publication Data
US 2009/0065403 A1 Mar. 12, 2009

(51) Int. Cl.
*B04B 5/12* (2006.01)
*B07B 4/00* (2006.01)

(52) U.S. Cl. ..... 209/713; 209/134; 209/135; 209/139.1

(58) Field of Classification Search ..... 209/134, 209/135, 136, 137, 138, 139.1, 140, 141, 209/142, 143, 713, 714
See application file for complete search history.

(56) References Cited

U.S. PATENT DOCUMENTS

| | | | | |
|---|---|---|---|---|
| 2,587,609 | A * | 3/1952 | Fisher | 241/39 |
| 4,390,419 | A * | 6/1983 | Barthelmess | 209/11 |
| 4,721,258 | A * | 1/1988 | Dougan et al. | 241/57 |
| 4,750,677 | A * | 6/1988 | Taylor | 241/5 |
| 5,215,491 | A * | 6/1993 | Willet et al. | 446/176 |
| 5,533,629 | A * | 7/1996 | Ito et al. | 209/714 |
| 5,865,381 | A * | 2/1999 | Mitsumura et al. | 241/18 |
| 5,957,300 | A * | 9/1999 | Nardi et al. | 209/143 |
| 6,273,269 | B1 * | 8/2001 | Cordonnier et al. | 209/714 |
| 6,318,559 | B2 * | 11/2001 | Cordonnier et al. | 209/154 |
| 7,900,779 | B2 * | 3/2011 | Kolacz | 209/714 |
| 8,033,399 | B2 * | 10/2011 | Pistorius et al. | 209/713 |
| 2009/0236451 | A1 * | 9/2009 | Nied | 241/5 |

FOREIGN PATENT DOCUMENTS

| | | |
|---|---|---|
| JP | S57-24188 | 5/1982 |
| JP | S57-24189 | 5/1982 |
| JP | 8-173909 A | 7/1996 |
| JP | 9-192606 A | 7/1997 |
| JP | 2002-119920 A | 4/2002 |

* cited by examiner

*Primary Examiner* — Stefanos Karmis
*Assistant Examiner* — Michael E Butler
(74) *Attorney, Agent, or Firm* — Price Heneveld LLP

(57) ABSTRACT

A centrifugal air classifier, in which a relation between an area S1 of a side surface of a cylinder or a truncated cone circumscribed about the rotor blades, an axis of the cylinder or a truncated cone being the rotor rotational shaft, and a calculation average value D of a diameter of a circle orthogonal to the rotor rotational shaft and circumscribed about the rotor blades is $S1/D^2$=0.9 to 1.6, and with the S1, a relation between a cross sectional area S2 of inflow of the air for classification and the D is $S2/D^2$=0.8 to 1.4.

46 Claims, 9 Drawing Sheets

Fig. 10a
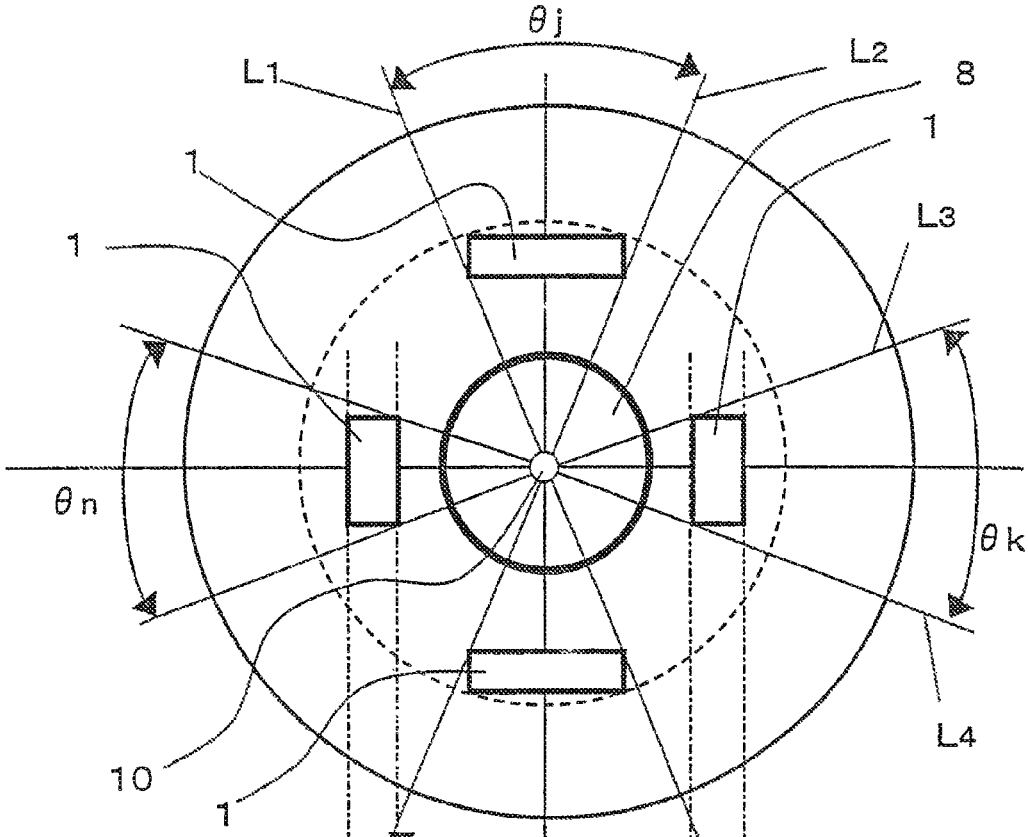
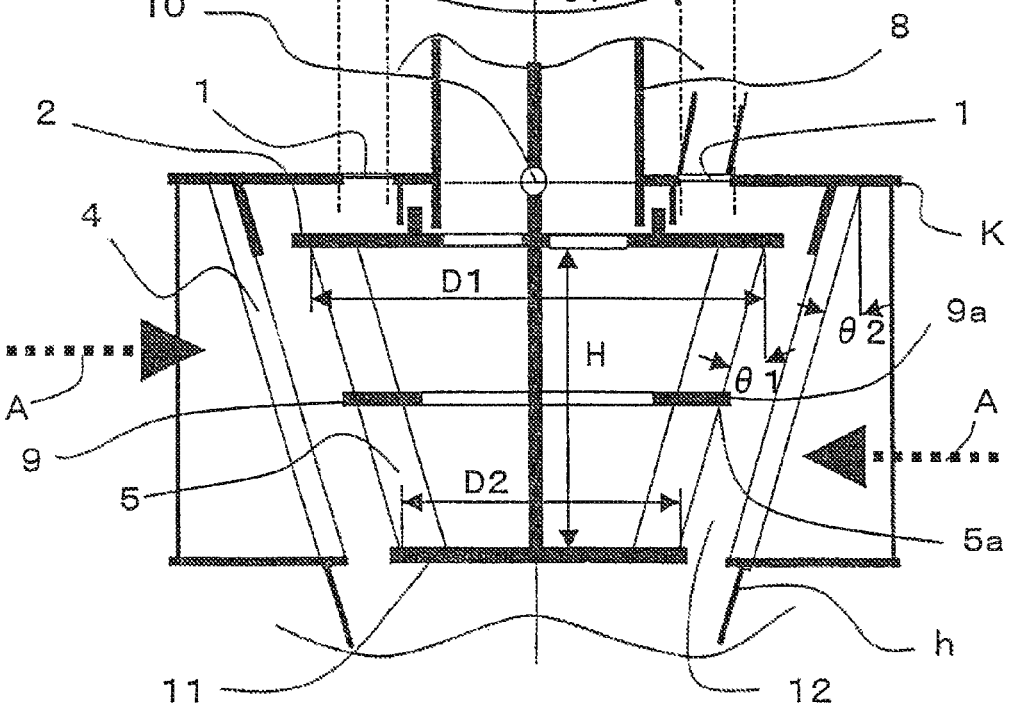
Fig. 10b

CENTRIFUGAL AIR CLASSIFIER

FIELD OF THE INVENTION

The present invention relates to a centrifugal air classifier for sorting a powder-shaped raw material into a coarse powder and a fine powder. Removing by means of a classifier an unnecessary size of particles in a powder obtained in a crushing operation or the like to obtain a necessary size of particles is regarded as important not only in the cement industry but also in many fields such as various kinds of mining and manufacturing industries, food industry, pharmaceutical industry and various kinds of chemical industries for the purpose of obtaining a function required to the powder and improving in function.

Among the above, in the various kinds of mining and manufacturing industries, the cement industry, the iron industry and the like, an extremely large quantity of powder subject to classification causes investment in plant and equipment and the running costs (such as expenses for electric energy) to be increased, so that decrease in cost is eagerly desired. This is also important in an aspect of saving energy of natural resources. On the other hand, a decrease in amount of investment in plant and equipment and running costs is strongly anticipated from the view point of economical efficiency in the above industries since the price of powder used in the industries is comparatively inexpensive.

BACKGROUND OF THE INVENTION

A centrifugal classifier, an inertial classifier, a gravity type classifier and such are used for carrying out a classifying operation for sorting powder into a coarse powder and a fine powder (a minute powder) according to the size of each particle of the powder for the purpose of creating or improving a function required to the powder. Among the above classifiers, the centrifugal classifier is most widely used from the viewpoint of easy control of a particle size, mass processing efficiency, high accuracy in classification and such (See JP-B-S57-24188 and JP-B-S57-24189, for example).

Especially in the various kinds of mining and manufacturing industries, the cement industry, the iron industry and the like, an extremely large quantity of powder subject to classification causes investment in plant and equipment and the running costs (such as expenses for electric energy) to be increased, so that establishment of a technique for decreasing the costs without deteriorating accuracy in classification in a centrifugal classifier is also strongly desired from the viewpoint of not only economical efficiency but also saving in energy of natural resources.

In a centrifugal classifier, a large amount of air or gas is continuously used. Generally, the accuracy in classification is greatly deteriorated when the flow rate of air or gas per unit mass of a powder to be processed is decreased. Such a kind of classifier is also called a centrifugal air classifier.

Further, a fine powder after classification is included in the large amount of air or gas passed through the classifier. In order to collect the fine powder from the air or gas including dust, a large-sized dust collector is required.

Accordingly, establishing a technique capable of reducing the flow rate of the air or gas without deteriorating the accuracy in classification enables a main body of the classifier to be reduced in size, a fan or blower to be reduced in capacity and a dust collector such as a bag filter to be reduced in capacity, so that both costs for plants and equipment and running costs can be reduced.

However, when the flow rate of the air or gas is decreased with a current centrifugal classifier without properly changing a structure of the classifier, the accuracy in classification is greatly deteriorated as described above, and thereby, quality (function) of a powder product and a ratio of collection of a product powder (on any one of the fine powder side and the coarse powder side) are deteriorated. This causes a tendency of deterioration, as a result.

SUMMARY OF THE INVENTION

In view of the above, an object of the present invention is to achieve a required classification performance with the flow rate of the air or gas lower than the conventional flow rate.

The inventor of the present invention examined whether or not the flow rate of the air or gas necessary for classification could be decreased by making any change in the structure of the existing centrifugal classifiers exemplified in FIGS. 1 and 2. A representative example of the centrifugal classifiers in FIGS. 1 and 2 comprises a casing k whose lower part is formed into a cone-shaped hopper h, an air inlet 7 provided in the tangental direction to a cylindrical part of the casing, a fine powder outlet 8 mounted to the top of the casing, a rotor rotational shaft 10 mounted to the almost center in the cylindrical part of the casing for rotating by means of a motor M, a rotational plate 11 fixed to the rotational shaft 10, a dispersion plate 2 mounted to a place where a powder raw material 3 falls from the powder inlet 1, a plurality of rotor blades 5 whose one ends are fixed to the rotational plate 11 and whose other ends are fixed to the dispersion plate 2, a partition plate 9 mounted to the rotor blades 5 for partitioning a classification chamber defined between the dispersion plate 2 and the rotational plate 11 into a plurality of stories and guide vanes 4 provided in the casing k so as to be opposed to the rotor blade 5 through a classification space 12. The structures and effects of the centrifugal air classifiers in FIGS. 1 and 2 are basically the same except for a point that the cylindrical rotor, namely, the rotational plate 11 and the dispersion plate 2 are formed to be the same in diameter and the guide vanes 4 and the rotor blades 5 are provided parallel to the rotor rotational shaft 10 (in vertical direction) in the classifier in FIG. 1 while the truncated cone-shaped rotor, namely, the rotational plate 11 is formed to be smaller in diameter than the dispersion plate 2 and the rotor blades 5 and the guide vanes 4 are inclined at angles of inclination θ1 and θ2 with respect to the rotor rotational shaft 10 in the classifier in FIG. 2. The angles of inclination θ1 and θ2 are suitably selected in a range of 0 to 40 degrees, for example.

In a conventional common sense, it has been known as a fact that, in a same classifier, decrease in flow rate of the air or gas to be used in classification (hereinafter referred to as "air for classification") causes great deterioration in accuracy in classification and ratio of collection of products.

As a result of detailed analysis of the fact by the inventor of the present invention, it was found that the rotational speed of the rotor and a component of the velocity of the air for classification inward in a radial direction of the rotor had a great influence on the accuracy in classification and the ratio of collection of products. That is, it was found that decreasing the flow rate of the air for classification as described above caused deterioration in accuracy in classification and ratio of collection because the rotational speed of the rotor should be also decreased in order to keep the diameter of the classified particle the same and this caused a decrease in both of the above-mentioned rotational speed of the rotor and the component of the velocity of the air for classification inward in a radial direction of the rotor.

The result of analysis means that the rotational speed of the rotor and the component of the velocity of the air for classification inward in a radial direction of the rotor should not be decreased in order to maintain the accuracy in classification and the ratio of collection.

Further, the inventor of the present invention paid attention to the height of the rotor. Regarding improvement in accuracy of classification and ratio of collection, there is not any established quantitative theory with respect to the height but only two opposite qualitative opinions. The first opinion is that "the height of the rotor should be sufficiently high in order to give all particles enough opportunities of classification". On the other hand, the second opinion is that "the height of the rotor should be low in order to quickly complete classification for the purpose of preventing an unnecessary size of particles from being mixed in the classification".

FIG. 3 shows the first opinion as a simplified imaginary illustration. In FIG. 3, the signs and numerals of the same as those in FIGS. 1 and 2 have the same names and functions. The powder raw material 3 supplied from the powder inlet 1 onto the dispersion plate 2 enters into the classification space 12 defined between the guide vanes 4 and the rotating rotor blades 5 and is subject to classification in accordance with the balance between the centrifugal force and resistance force that acts on the particles during the fall in the space 12. The balance is determined according to the rotational speed of the rotor 6 and the flow rate of the air for classification supplied from the air inlet 7. A small particle B which enters inside the rotor blades 5 with the air for classification A is to be discharged from the fine powder outlet 8 and a fine powder (a minute powder) B is sorted and caught for collection in a dust collector (not shown in the drawings).

On the other hand, a large particle (a coarse powder) C which falls in the classification space 12 is to be collected in a cone part (not shown in FIG. 3) provided at a lower place. At that time, it is considered that the classification requires time on the basis of movement of the particles and it takes a longer time to separate (disperse) the fine powder B adhered to the large particle C, as shown in FIG. 3. In other words, if the above time and the time for a group of particles to fall are calculated accurately, it allows a proper value of the height of the rotor to be calculated. However, there has been no body of theory at all about the calculation of the above time and the time for a group of particles to fall. The technique is below the level of calculation or simulation even when a high-performance computer is used. Moreover, there is a problem that the above-mentioned classifier should be made of metal since it requires a strong structure, so that it is impossible to observe the movements of the group of particles inside the classifier in a visual way. Under such a condition, each designer has no choice but to determine the height of the rotor with no technically supported reason and without knowing whether the height is of a proper value or not.

FIG. 4 shows an example of a widely sold classifier in which the second opinion is put into practice and the height of the rotor is made extremely low. In FIG. 4, the signs and numerals of the same as those in the previously-mentioned drawings have the same names and functions. In FIG. 4, 15 denotes a classification rotor, 16 denotes air and a raw material, 17 denotes a dispersion blade, 19 denotes a classification blade, 20 denotes a coarse powder outlet, 21 denotes air, 22 denotes a spiral casing, 23 denotes a balance rotor overlapping with the classification rotor 15, 24 denotes a supporting pedestal and 25 denotes a rotor rotational shaft.

As a result of an experimental examination by the inventor of the present invention for the above-mentioned kind of centrifugal classifier, the accuracy in classification was good only in the case of classification of a fine powder and of an extremely small quantity of powder to be supplied. However, both the accuracy in classification and the ratio of collection of products were greatly deteriorated when the quantity of powder to be supplied increases to an industry scale. Thus, the opinions about the height of the rotor have not been established as a theory and it can be said that the optimal design for the height conventionally has depended on an arbitrary decision of the respective designers. Accordingly, it is required to examine the proper height of the rotor for the purpose of maintaining the accuracy in classification and the ratio of collection without deteriorating the rotational speed of the rotor and an inward component of the velocity of the air for classification in the radius direction of the rotor. Manufacturing rotors of various heights for a classifier in various sizes to carry out experiments allows a useful effect to be achieved but costs several tens of billions of dollars. This has no reality at all in the field. After various kinds of consideration, the inventor of the present invention found a realistic method of examination. The method is to select a centrifugal air classifier, which has been used for a long time, 15 years or more, for example, as a classifier in actual operation in a cement field or the like, to examine abrasion of the rotor blades.

In the way of the consideration of the method, as shown in a simplified imaginary illustration in FIG. 3, the powder raw material supplied from the upper part undergoes a classification operation, a diameter of a particle, which is on a border between the side of fine powder B (entering inside the rotor with air to be discharged) and the side of the coarse powder C (falling downward to be discharged), is a cut-off size of a particle in diameter and the classification operation on a powder is actually carried out at the tops of the rotor blades 5 (the outer circumferential part of the arranged rotor blades 5), so that the abrasion of the tops of the rotor blades 5 must advance as long as the operation is carried out. That is, in examination of a state of the abrasion of the tops of the rotor blades 5 in a direction of the height of the rotor, the abrasion must have been advanced at the upper part, of course, while the lower part not abraded at all means that the part has not undergone classification operation, namely, is redundant for the classifier, and therefore, it can be said that such lower part is omissible.

In the examination of the above for various kinds of centrifugal air classifiers, it was found that the abrasion of the rotor blades were extremely little and the objective investigations cannot be completed without carrying out examination for the centrifugal air classifier having been used for 15 years or more.

FIGS. 5*a*-5*c* show a state of abrasion of rotor blades of the classifier which has been used for 15 years or more in actual operation of three kinds A (in FIG. 5*a*), B (in FIG. 5*b*) and C (in FIG. 5*c*) different in size and processing quantity from each other. The measured abrasion depth d is shallow as much as 2 mm at the maximum. In FIGS. 5*a*-5*c*, only the abrasion depth is shown in enlarged dimension for the purpose of easy understanding.

As seen from FIGS. 5*a*-5*c*, the rotor blade 5 is provided between the dispersion plate 2 and the rotation disk 11 and partitioned into a plurality of stories by means of the horizontal annular partition plate 9. An abrasion part m of the rotor blade 5 decreases from the upper part 5*a* toward the lower part 5*b* and abrasion is not detected at the lower part 5*b*. It can be considered that abrasion of a part just below the horizontal partition plate 9 is little because there is an area where powder scarcely exists since the powder falling from the vicinity of a tip end 9*a* of the partition plate 9 receives the classification operation to go to the tip end of the rotor blade 5 (the fine powder further goes to the inside of the rotor during the fall in the vertical direction due to gravity).

Here, examined was a point (a border point) CP at which the abrasion depth d was assumed to be zero when the deepest points of the abrasion depth d were connected by means of a line T as shown in FIGS. 5*a*-5*c* in order to specify a border between a part undergoing the classification operation and a part not undergoing the operation in the direction of the height of the tip end of the rotor blade 5.

The inventor of the present invention studied what relation the point CP has with the capacity of a classifier (the size of a classifier based on the processing quantity). As a result, the following method was found.

That is, calculating the later-mentioned S1 and S2 on the basis of a size of respective parts in design with H' denoting a distance in the vertical direction from the point CP to the dispersion plate and plotting the calculated values with respect to a square of a diameter D of a circumscribed circle about the rotor blades 5 allowed a straight-line relation to be obtained.

Now, S1 and S2 will be described with reference to FIGS. 2, 5*a*-5*c* and 6. The signs and numerals of the same as those in the previously-mentioned drawings have the same names and functions. S1 is an area of a side surface of a cylinder (or a truncated cone) circumscribed about the rotor blades 5, an axis of the cylinder being the rotor rotational shaft 10, (the side area of the rotor) (in meters squared). The S1 (the side area of the rotor) can be calculated by:

$$\pi H'(D1+D2)/2,$$

wherein H' denotes a height (in meters) of the rotor blade 5 from the dispersion plate to the point CP in the vertical direction and (D1+D2)/2 denotes an average value (in meters) in calculation of a diameter of a circle crossing with the rotor rotational shaft at right angles and circumscribed about the rotor blade, the diameter. D1 denotes a diameter (in meters) of a circle circumscribed about the rotor blades 5 at the upper end portion thereof while D2 denotes a diameter (in meters) of a circle circumscribed about the rotor blades at the point CP. In the cylindrical rotor shown in FIGS. 1 and 5*a*-5*c*, the average diameter is D=D1=D2. S2 denotes a cross sectional area (in meters squared) of inflow of the air for classification. The S2 (the cross sectional area of inflow of the air for classification) is calculated by:

S1−(the cross sectional area SB of the rotor blade+the cross sectional area SH of the partition plate 9)+the area SY of an overlapping part between the rotor blades and the partition plate 9. The cross sectional area SB is a cross sectional area (in meters squared) between the dispersion plate of the rotor blade and the point CP. The SB can be obtained by tB·H'·nB. The sign tB denotes a thickness (in meters) of the rotor blade 5 and nB denotes the total number of the rotor blades, respectively. The cross sectional area SH can be obtained by π·DH·tH·nH. DH denotes a diameter (in meters) of the partition plate 9, tH denotes a thickness of the partition plate 9 and nH denotes the total number of the partition plates 9 existing between the dispersion plate and the point CP, respectively. The area SY of the overlapping part between the rotor blades and the partition plate can be obtained by tB·tH·nB·nH. Incidentally, there is a case that a rotor has no partition plate. In such a case, S2=S1−SB since SH=0. The straight-line relation of the S1 or S2 and the $D^2$ in FIGS. 7 and 8 means that a ratio of S1 and $D^2$ or a ratio of S2 and $D^2$ is of a constant value of around 0.93 and 0.80, respectively, irrespective of the difference in capacity (size) of the classifier.

D×D (=$D^2$) of a horizontal axis in FIGS. 7 and 8 denotes a difference in size (processing quantity) of a classifier device, Incidentally, (S1/$D^2$) and (S2/$D^2$) in Table 1 denote values similarly calculated with a conventional size of the rotor of the classifier (wherein H denotes a height of the rotor blade) without taking the position of the point CP into consideration.

TABLE 1

| CLASSIFIER | A | B | C |
|---|---|---|---|
| D (m) | 1.54 | 2.15 | 2.64 |
| H (m) | 0.873 | 1.265 | 1.551 |
| S1 | 4.22 | 8.54 | 12.86 |
| S2 | 3.64 | 7.36 | 11.07 |
| (S1/$D^2$) | 1.78 | 1.85 | 1.85 |
| (S2/$D^2$) | 1.54 | 1.59 | 1.59 |
| S1/$D^2$ | 0.89 | 0.93 | 0.93 |
| S2/$D^2$ | 0.77 | 0.80 | 0.80 |

Designing the rotor and the rotor blades to be smaller than S1 and S2 has a sufficient probability of deterioration in accuracy in classification and ratio of collection of products. On the other hand, designing the above to be larger than S1 and S2 causes no problem of the accuracy in classification and the ratio of collection but causes increase in the amount of investment in plant and equipment and running costs.

Accordingly, S1 and S2 may be determined arbitrarily within a range a little larger than the values shown in FIGS. 7 and 8 in view of some safety. The range can be expressed by means of S1/$D^2$ and S2/$D^2$ as follows:

$$S1/D^2=0.9 \text{ to } 1.6, S2/D^2=0.8 \text{ to } 1.4.$$

The above-mentioned point CP, however, is a border point where abrasion of the tip end of the rotor blade is not detected, and therefore, in the lower part from the border, there is no guarantee that the classification operation does not exist although no large-scale classification occurs. Further, an effect of reduction in the amount of investment in plant and equipment and running costs becomes small when the height of the rotor and the rotor blade becomes high, that is, when the value of S1/$D^2$ or S2/$D^2$ becomes large. On the other hand, deterioration in accuracy in classification and ratio of collection is likely to occur when the value of S1/$D^2$ or S2/$D^2$ becomes too small.

Accordingly, the above-mentioned S1/$D^2$ and S2/$D^2$ should preferably be in a range of:

$$S1/D^2=1.1 \text{ to } 1.5, S2/D^2=0.9 \text{ to } 1.3.$$

Moreover, the inventor of the present invention carried out an experiment that, with the classifier having two powder inlets and provided in a direction of 180° with respect to the rotor rotation shaft, one powder inlet was closed while the whole quantity of the raw material powder were supplied from the other inlet. This results in great deterioration in accuracy in classification and ratio of collection.

The inventor of the present invention concluded that the reason of the above was that the powder supplied to the classifier entered from the outer circumferential part of the dispersion plate in the upper part of the rotor into the classification space (between the guide vane and the rotor blades) to undergo a classification operation, and at that time, the concentration of the powder per a unit space was lower in the case that the powder entered evenly and as widely as possible from the whole outer circumference of the dispersion plate than the case that the powder entered intensively from any one place of the outer circumference part of the dispersion plate, and thereby, the dispersion of the powder was accelerated, so that the classification became close to the desirable one.

That is, it can be considered that setting the height of the rotor in accordance with the invention causes no deterioration in accuracy in classification and ratio of collection even in the case that an unvigorous classification that occurs below the point CP (the border point) is omitted, since properly providing the powder inlet causes improvement in accuracy in classification and ratio of collection.

As a concrete method of the above, most preferable is a method of providing the powder inlet at one place in an area including at the center thereof the rotor rotational shaft 10 as shown in FIG. 9 from the viewpoint of even dispersion of a powder over the whole outer circumference of the upper part of the rotor 6.

However, the method has a disadvantage that the powder raw material 3 goes to the outer circumference of the upper part of the rotor 6 at a low speed, and thereby, the powder raw material cannot be supplied at a comparatively high speed since the centrifugal force operates little on the supplied powder raw material 3 in the vicinity of the rotor rotational shaft 10 of the dispersion plate 2.

In FIG. 9, the signs and numerals of the same as those in the previously-mentioned drawings have the same names and functions. In FIG. 9, the fine powder outlet 8A is provided below the rotor 6.

The inventor of the present invention confirmed by experiments that the speed for supplying the powder raw material could be sufficiently high in view of industry and the accuracy in classification could be close to the accuracy in the case of even dispersion over the whole circumference when the following conditions were satisfied. That is, one or plural square powder inlet 1 is provided in a place not including rotor rotational shaft 10 and the sum (for all powder inlets) θF of interior angles θi and θj and interior angles of θk and θn respectively formed from two lines of L1 and L2 and two lines of L3 and L4, which extend from the rotor rotational shaft 10 so as to circumscribe about horizontal cross sections of the respective powder inlets 1 and which are vertical to the rotor rotational shaft 10, is set at 90° or more, namely, $90° \leqq \theta F \leqq 360°$, for example, as shown in FIGS. 10*a*-*b*. The powder inlets in the above case, of course, can be provided as even as possible over the whole circumference without being biased in the circumferential direction.

The shape of the powder raw material inlet 1 is not limited to a square shape. The shape and size of the inlet 1 is properly selected in accordance with necessity.

In FIGS. 10*a*-*b*, the signs and numerals of the same as those in the above drawings have the same names and functions.

As seen from the examination of FIGS. 5*a*-5*c*, a part just below the horizontal partition 9 of the rotor blade 5 is abraded a little and contributes little to classification. Accordingly, the length w of projection of the top 9*a* of the partition plate 9 from the top 5S of the rotor blade 5 can be as small as possible for the purpose of achieving an effective classification operation in a whole area in the direction of the height of the top of the rotor blade. The length w of the projection can be set at 0 to 7 mm, for example, and can be, 2 to 5 mm so that the top 5S of the rotor blade 5 and the top 9*a* of the partition plate 9 would be located in a substantially same plane.

The above-mentioned countermeasures allow a centrifugal air classifier not using unnecessarily voluminous air (air or gas) for classification to be designed. Also, it becomes dispensable to provide an unnecessarily large fan or a blower, which is provided additionally, and an unnecessarily large bag filter used as a dust collector.

The flow rate of air or gas, which is determined as described above, also has an influence on the size of the rotor. In other words, the air for classification flowing into the rotor through the guide vanes is required to transport in the form of an air flow including dust the whole quantity of the powder, which is classified into the fine powder side, to a dust collector via the rotor, the fine powder outlet and a duct connected thereafter. Therefore, the rotor and the vicinity thereof can be designed so that a component in a vertical direction of the velocity of the air or gas at the top part of the rotor can be 12 m/s or more, and can be, 16 to 22 m/s when the air or gas goes to the duct connected to an upper part of the rotor in the rotor.

BRIEF DESCRIPTION OF THE DRAWINGS

FIGS. 1 to 6 show centrifugal classifiers used in the experiments. FIG. 1 is a perspective view of a classifier provided with a cylindrical rotor. FIG. 2 is a vertical sectional view of a classifier provided with a rotor in the shape of a truncated cone.

FIGS. 3 and 4 show centrifugal classifiers used in the experiments for comparing the height of rotors. FIG. 3 is an enlarged view of a conventional centrifugal air classifier including a high rotor. FIG. 4 is an enlarged view of a centrifugal air classifier including a low rotor.

FIGS. 5*a*-5*c* and 6 show centrifugal air classifiers used in experiments for examining a part of a rotor blade, which contributes to classification. FIG. 5*a* is an enlarged view of an integral part of a comparatively small-sized centrifugal air classifier comprising two partition plates. FIG. 5*b* is an enlarged view of an integral part of a middle-sized centrifugal air classifier comprising three partition plates. FIG. 5*c* is an enlarged view of an integral part of a comparatively large-sized centrifugal air classifier comprising four partition plates. FIG. 6 is an enlarged perspective view of an integral part for illustrating formulas for calculating the side area S1 of a rotor and a cross sectional area S2 of inflow of air.

FIGS. 9 and 10*a*-*b* show centrifugal air classifiers used in experiments for comparing effect of classification according to the number of inlet for supplying powder. FIG. 9 is a vertical sectional view of a centrifugal air classifier provided with one powder inlet 1. FIGS. 10*a*-*b* show a centrifugal air classifier provided with a plurality of powder inlets. FIG. 10*a* is a plane view. FIG. 10*b* is a vertical sectional view.

DETAILED DESCRIPTION OF AN EMBODIMENT OF THE INVENTION

Figure 1:
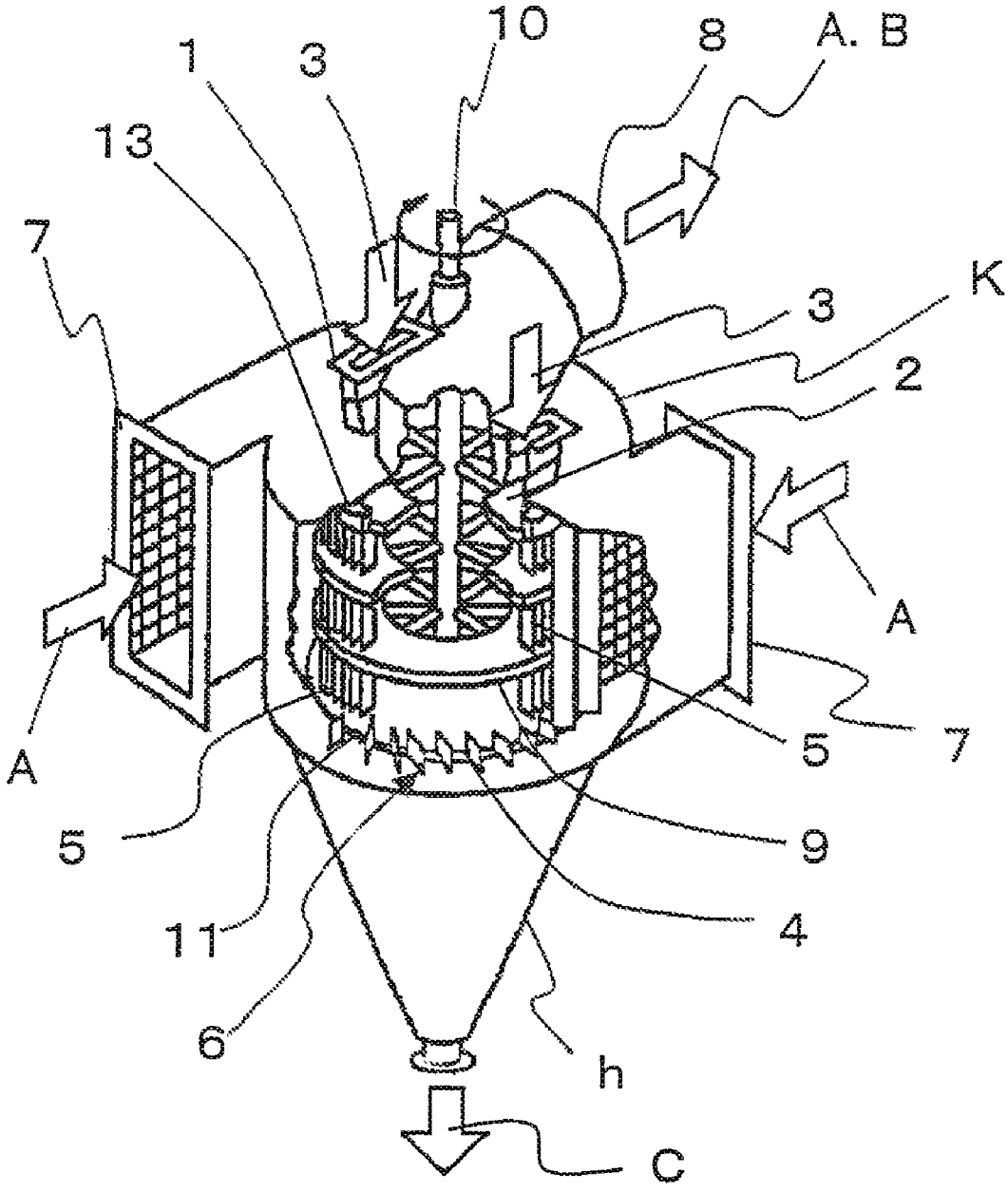

An aspect of the present invention provides a centrifugal air classifier comprising: a rotor provided in a casing and including a dispersion plate and a rotational plate, the plates being fixed to a rotor rotational shaft with a space therebetween in an axial direction, and a plurality of rotor blades held between outer circumferential parts of the both plates; guide vanes provided outside the rotor blades so as to be opposed to the rotor blades through a classification space; an air inlet provided in the casing for supplying the classification space with air for classification through the guide vanes; a powder inlet provided in an upper part of the casing so as to be faced to the dispersion plate; and a fine powder outlet for discharging a classified fine powder to the outside of the classifier, wherein a relation between an area S1 of a side surface of a cylinder or a truncated cone circumscribed about the rotor blades, an axis of the cylinder or a truncated cone being the rotor rotational shaft, and a calculation average value D of a diameter of a circle orthogonal to the rotor rotational shaft and circumscribed about the rotor blades is $S1/D^2=0.9$ to 1.6.

Another aspect of the present invention provides a centrifugal air classifier comprising: a rotor provided in a casing and including a dispersion plate and a rotational plate, the plates being fixed to a rotor rotational shaft with a space therebetween in an axial direction, and a plurality of rotor blades held between outer circumferential parts of the both plates; guide vanes provided outside the rotor blades so as to be opposed to the rotor blades through a classification space; an air inlet provided in the casing for supplying the classification space with air for classification through the guide vanes; a powder inlet provided in an upper part of the casing so as to be faced to the dispersion plate; and a fine powder outlet for discharging a classified fine powder to the outside of the classifier, wherein a relation between a cross sectional area S2 of inflow of the air for classification and the calculation average value D of the diameter is $S2/D^2=0.8$ to 1.4.

Yet another aspect of the present invention provides a centrifugal air classifier comprising: a rotor provided in a casing and including a rotational plate and a dispersion plate, the plates being fixed to a rotor rotational shaft with a space therebetween, and a plurality of rotor blades held between outer circumferential parts of the both plates; guide vanes provided outside the rotor blades so as to be opposed to the rotor blades through a classification space; an air inlet provided in the casing for supplying the classification space with air for classification through the guide vanes; a powder inlet provided in an upper part of the casing so as to be faced to the dispersion plate; and a fine powder outlet for discharging a classified fine powder to the outside of the classifier, wherein a relation between the S1 and the D is $S1/D^2=0.9$ to 1.6 and a relation between the S2 and the D is $S2/D^2=0.8$ to 1.4.

The powder inlet in accordance with an embodiment of the invention is provided in a place including the rotor rotational shaft.

The powder inlet in accordance with an embodiment of the invention is provided in one or plural number in a place not including the rotor rotational shaft.

The air for classification flowing into the rotor through the classification space has a component of velocity in vertical direction of 12 m/s or more, and can be, 16 m/s to 22 m/s at the tip end of the rotor in flowing toward the fine powder outlet.

The rotor blades are partitioned into a plurality of stories by means of horizontal annular partition plates and the tip end of the partition plate is located in a substantially same plane as the tip end of the rotor blade.

The tip end of the partition plate is projected by 0 to 7 nm from the tip end of the rotor blade.

Embodiment 1

A first embodiment of the present invention will be described.

Figure 2:
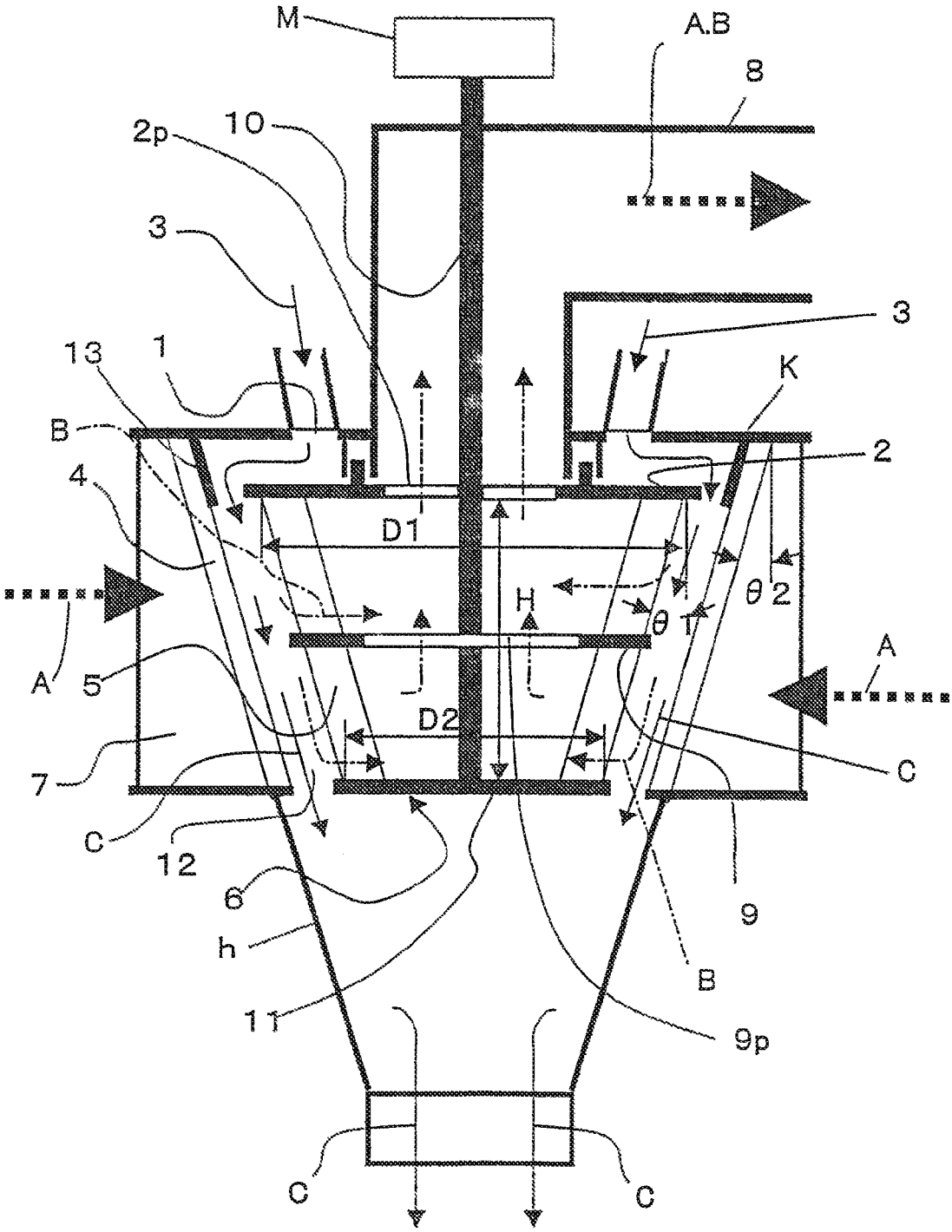
Figure 3:
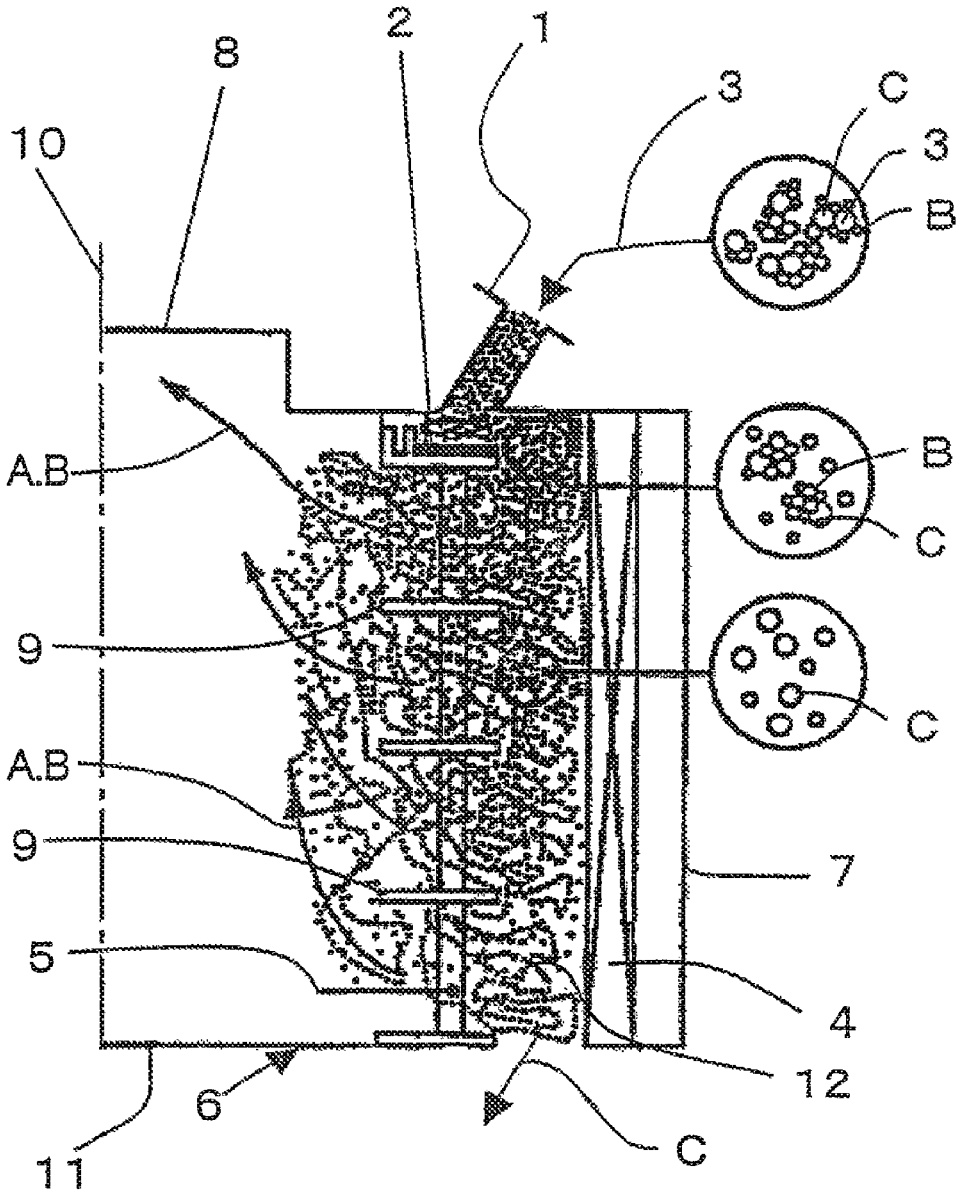
Figure 4:
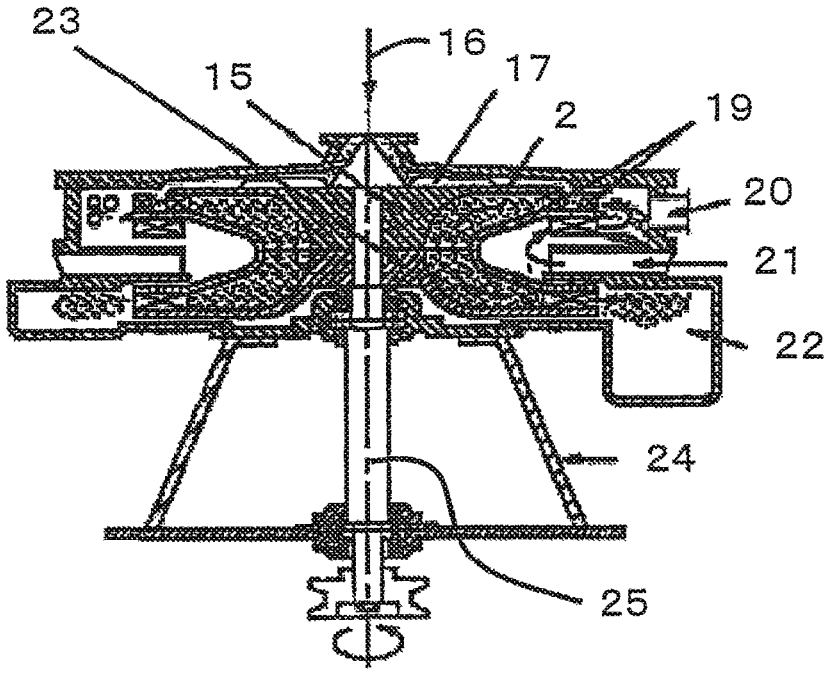
Figure 5A:
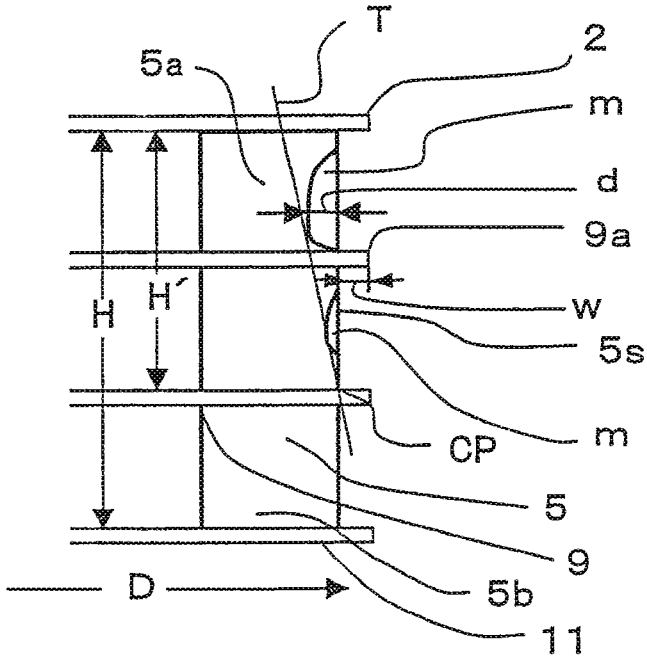
Figure 5B:
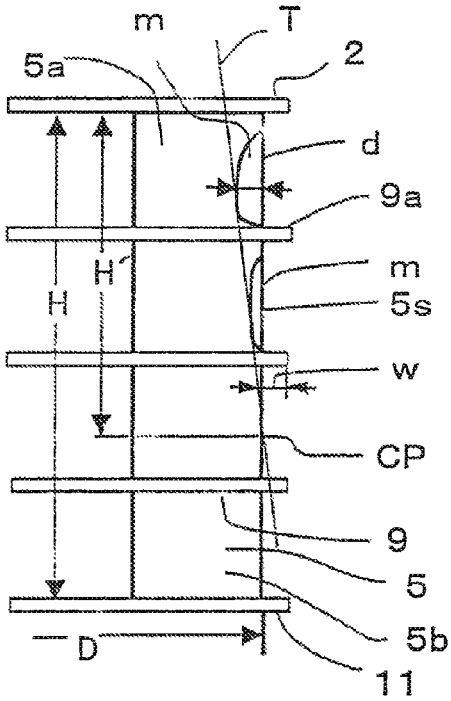
Figure 5C:
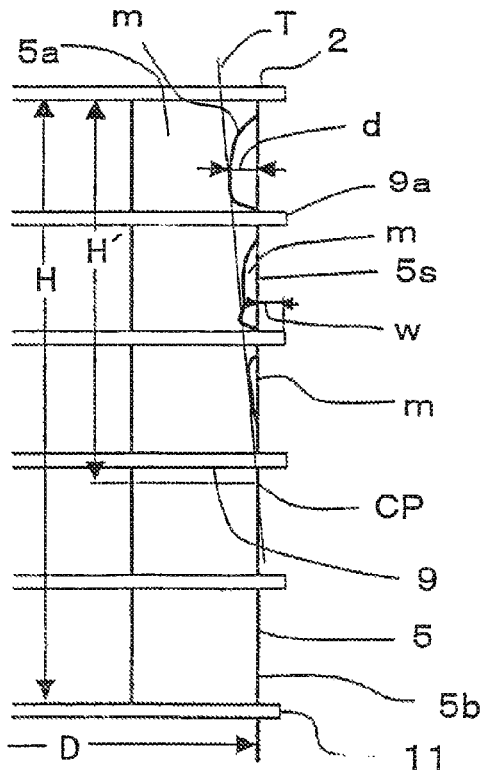
Figure 6:
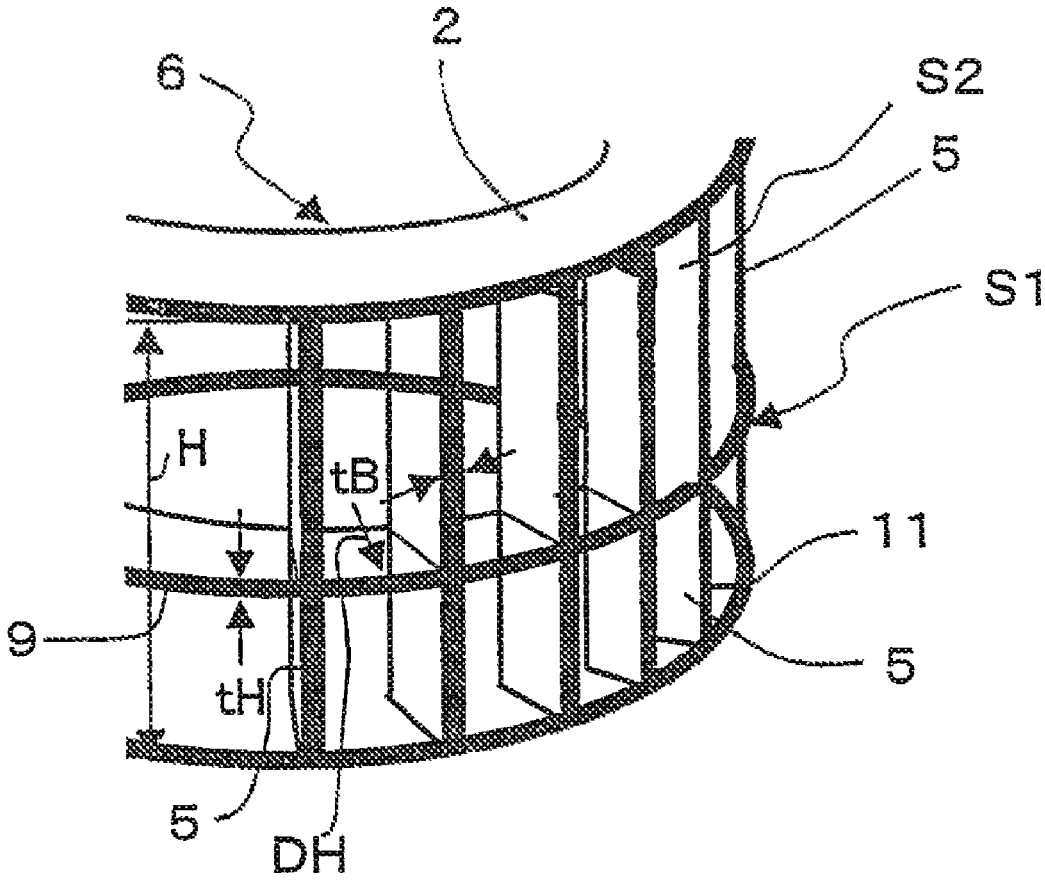
Figure 7:
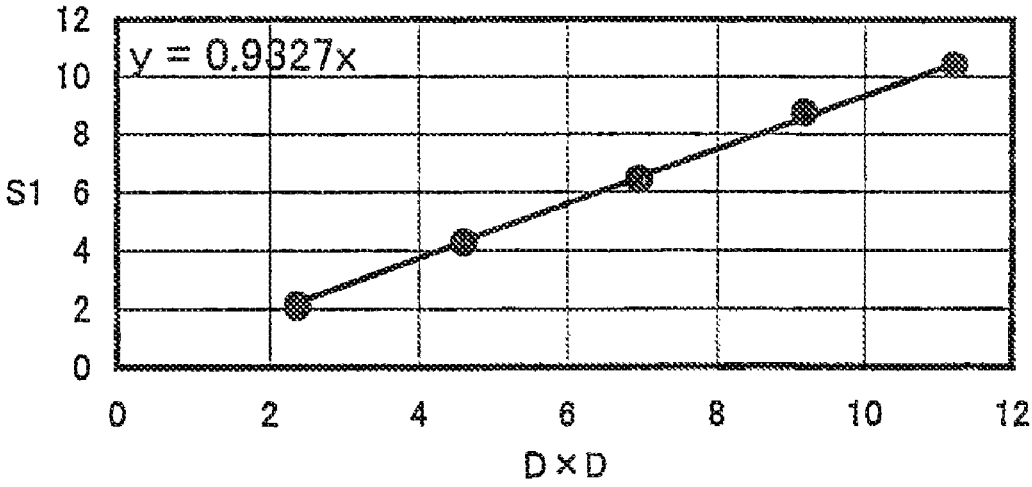
FIG. 7 illustrates a relation between the S1 and the D×D.
Figure 8:
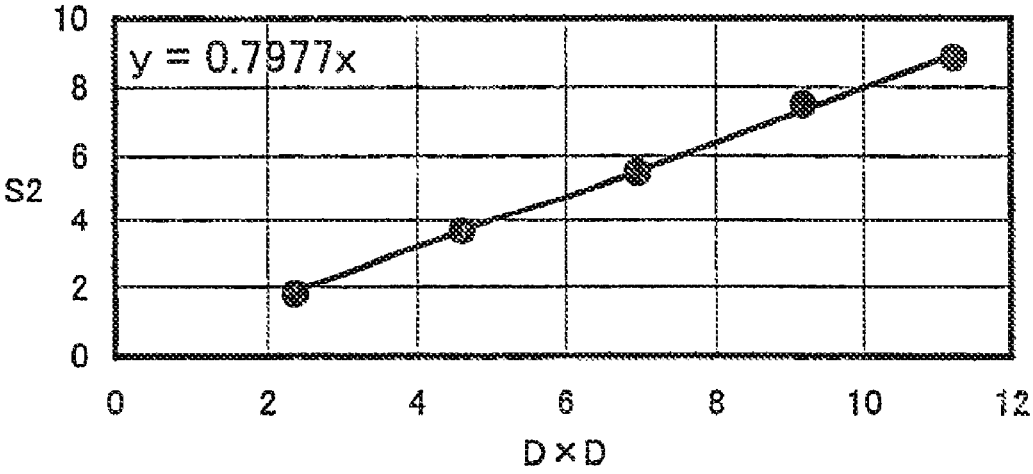
FIG. 8 illustrates a relation between the S2 and the D×D.
Figure 9:
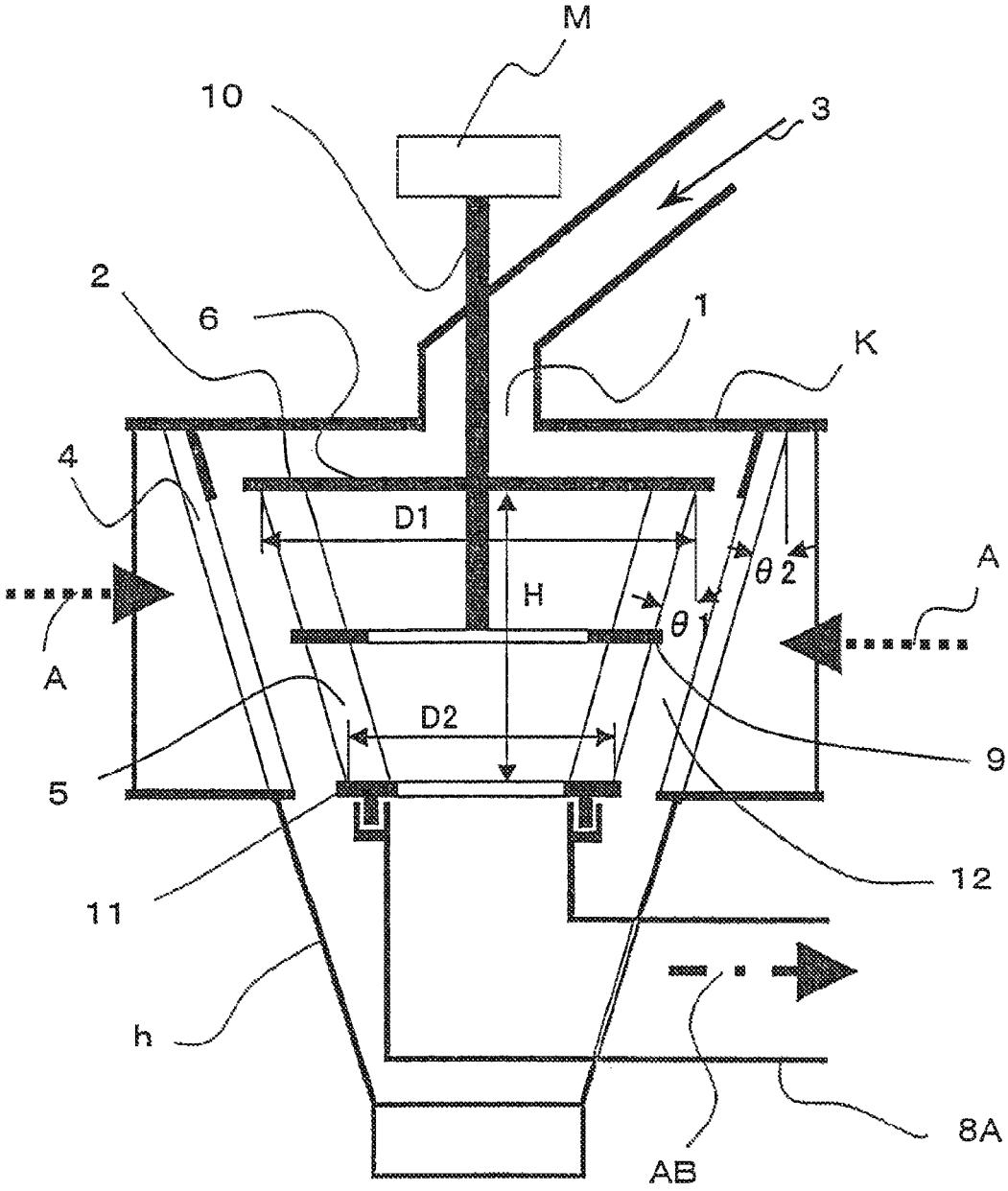

A centrifugal air classifier shown in FIGS. 1 and 2 is a typical classifier having been conventionally used and being in actual operation in world cement plants widely. As described above, the classifier comprises a casing k whose lower part is formed into a cone-shaped hopper h, an air inlet 7 provided in the tangent direction to a cylindrical part of the casing, a fine powder outlet 8 mounted to the top of the casing, a rotor rotational shaft 10 mounted to the almost center in the cylindrical part of the casing, a rotational plate 11 mounted to the rotational shaft 10, a dispersion plate 2 mounted to a place where a powder raw material 3 falls from the powder inlet 1, a plurality of rotor blades 5 whose one ends are fixed to the rotational plate 11 and whose other ends are fixed to the dispersion plate 2, a horizontal partition plate 9 mounted to the rotor blades 5 for partitioning a classification chamber formed between the dispersion plate 2 and the rotational plate 11 into a plurality of stories and guide blades 4 provided in the casing k so as to be opposed to the rotor blade 5 through a classification space 12.

An operation of the air classifier will be briefly described. The powder raw material 3 thrown from the powder inlet 1 falls onto the dispersion plate 2 of the rotating rotor 6 to be dispersed and scattered in the horizontal direction, has a collision with a collision plate 13 to be dispersed (or crushed), and then, falls in the classification space 12. At that time, air (air or gas) for classification A has been supplied from the air inlet 7 to flow into the classification space 12 through the guide vanes 4.

The velocity of the air for classification A has a component toward the center of the rotor 6 to form a vortex air flow. The air for classification A is accelerated to the velocity necessary for classification by means of the rotor blade 5. The particle (powder raw material) 3 supplied to the classification space 12 starts a gyrating movement together with the air for classification A. At that time, classification is performed in accordance with the balance between the centrifugal force and resistance force, which operate on the grain. A grain (fine powder) B having a diameter smaller than the diameter of a cut-off size of particles which is determined by the balance, enters into the rotor 6 together with the air for classification A, is discharged to the outside of the classifier from the fine powder outlet 8 through a center through-hole of the dispersion plate 2 and the partition plate 9 and caught for collection by a bag filter not shown in the drawings. A particle (coarse powder) C having a diameter larger than that of the cut-off size of particles is repeatedly classification-operated to sink due to gravity and discharged from the lower part of the hopper h. Incidentally, the diameter of the cut-off size of particles is adjusted in accordance with the rotational speed of the rotor 6.

The inventor of the present invention altered the centrifugal air classifier on the basis of the present invention to examine the flow rate of air, the accuracy of the classifier and a ratio of collection (evaluated by "quantity of crush" since a closed circuit crushing process connected to a crusher is applied in Embodiment 1), and obtained a result shown in Table 2.

In the examination, it was set that

S1 (in meters squared) was 8.54 before alteration and 5.98 after alteration, S2 (in meters squared) was 7.35 before alteration and 5.15 after alteration, and D (in meters) was 2.15 before alteration and 2.15 after alteration.

The setting was same in both of the cases of ordinal cement and high-early-strength cement.

TABLE 2

| | | | | ORDINAL CEMENT | | | |
|---|---|---|---|---|---|---|---|
| ITEM OF EVALUATION | | SIGN | UNIT | BEFORE ALTERNTION | BEFORE ALTERATION (REFERENCE) | AFTER ALTERATION* | AFTER ALTERATION** |
| CONDITION OF DESIGN | ROTOR | $S1/D^2$ | — | 1.85 | | 1.30 | |
| | ROTOR | $S2/D^2$ | — | 1.59 | | 1.11 | |

TABLE 2-continued

| | | | | | | | |
|---|---|---|---|---|---|---|---|
| (ITEM OF INVENTION) | POWDER INLET | n | PIECE | 2 | | 2 | 4 |
| | POWDER INLET | θF | ° | 40 | | 40 | 95 |
| FLOW RATE OF AIR FOR CLASSIFICATION | | Qa | $m^3$/min | 1600 | 1200 | 1120 | 1120 |
| | | | | | (▲25%) | (▲30%) | (▲30%) |
| RATIO OF COLLECTION ACCURACY IN CLASSIFICATION | CRUSH QUANTITY | Qf | t/h | 25 | 22 | 25 | 26 |
| | SPECIFIC SURFACE AREA | Sp | $cm^2$/g | 3270 | 3270 | 3280 | 3290 |
| | 32 μm RESIDUE | R (32) | % | 19 | 24 | 19 | 19 |
| | RATIO OF DIVISION | β | % | 29 | 42 | 26 | 24 |

| | | | | HIGH-EARLY-STRENGTH CEMENT | | | |
|---|---|---|---|---|---|---|---|
| ITEM OF EVALUATION | | SIGN | UNIT | BEFORE ALTERATION | BEFORE ALTERATION (REFERENCE) | AFTER ALTERATION* | AFTER ALTERATION** |
| CONDITION OF DESIGN | ROTOR | $S1/D^2$ | — | 1.85 | | 1.30 | |
| | ROTOR | $S2/D^2$ | — | 1.59 | | 1.11 | |
| (ITEM OF INVENTION) | POWDER INLET | n | PIECE | 2 | | 2 | 4 |
| | POWDER INLET | θF | ° | 40 | | 40 | 95 |
| FLOW RATE OF AIR FOR CLASSIFICATION | | Qa | $m^3$/min | 1720 | 1200 | 1200 | 1200 |
| | | | | | (▲30%) | (▲30%) | (▲30%) |
| RATIO OF COLLECTION ACCURACY IN CLASSIFICATION | CRUSH QUANTITY | Qf | t/h | 18 | 14 | 18 | 18 |
| | SPECIFIC SURFACE AREA | Sp | $cm^2$/g | 5000 | 4980 | 4980 | 5000 |
| | 32 μm RESIDUE | R (32) | % | 2.5 | 4.8 | 2.5 | 2.3 |
| | RATIO OF DIVISION | β | % | 52 | 72 | 52 | 50 |

In Table 2, "specific surface area" totally indicates fineness of a powder product (cement in this case). "32 μm residue" is an index indicating quality of cement and accuracy in classification. The smaller the value in "32 μm residue" is, the higher (better) both of the quality and the accuracy are. "Ratio of division β" is an index indicating both of the accuracy in classification and the ratio of collection and means that the smaller the value is, the higher (better) both of the accuracy and the ratio of collection are. A method of calculating the ratio of division β and detailed description thereof are described in many publications. ("BASICS OF POWDER MACHINES AND DEVICES (FUNTAIKIKI·SOUCHI NO KISO)" written by ITO MITSUHIRO (KOGYO CHOSAKAI PUBLISHING. CO., LTD., 2005) p47 to p51, for example).

As seen from Table 2, in any one of cases of ordinary cement and high-early-strength cement, both of the ratio of collection and the accuracy in classification are greatly deteriorated when the flow rate of air for classification is decreased by 25% to 30% at a phase before alteration (in columns "BEFORE ALTERATION (REFERENCE)" in Table 2). After alteration in accordance with the present invention, however, both of the accuracy in classification (the 32 μm residue and the ratio of division β in this case) and the ratio of collection (the crush quantity in this case) are kept to be of the conventional values although the flow rate of air for classification is reduced by around 30%, compared with the value before the alteration. Further, increasing the number of the powder inlet allows the accuracy in classification and the ratio of collection to be improved a little. These values are extremely good values as an engineer concerned in cement manufacture can understand by a glance.

In Table 2, * denotes a case of reducing the flow rate of the air for classification by around 30% while ** denotes a case of reducing the flow rate of the air for classification by around 30% and increasing the number of the powder inlet.

Embodiment 2

Embodiment 2 shows a case that a comparatively large-sized classifier according to the present invention is newly provided instead of alteration. A centrifugal air classifier of the same kind as that of Embodiment 1 is redesigned on the basis of the invention. As a subject for comparison in performance, used is a centrifugal classifier of the same kind as that of Embodiment 1, the classifier having the same production scale and being in operation adjacently in the same cement plant, wherein the technique of the invention is not applied to the classifier. The data is shown in Table 3.

In Table 3, S1 (in meters squared) is 9.00 in the present embodiment and 12.86 in the subject for comparison, S2 (in meters squared) is 7.75 in the present embodiment and 11.07 in the subject for comparison and D in meters) is 2.64 in the present embodiment and 2.64 in the subject for comparison. In any one of the cases of ordinal cement and high-early-strength cement, the setting was same.

TABLE 3

| ITEM IN EVALUATION | | SIGN | UNIT | NEWLY PROVIDED (CLASSIFIER ACCORDING TO THE INVENTION) | SUBJECT FOR COMPARISON (ADJACENT CONVENTIONAL CLASSIFIER) |
|---|---|---|---|---|---|
| CONDITION FOR DESIGN (ITEM IN THE INVENTION) | ROTOR | $S1/D^2$ | — | 1.30 | 1.84 |
| | ROTOR | $S2/D^2$ | — | 1.11 | 1.59 |
| | POWDER INLET | N | PIECE | 8 | 4 |
| | POWDER INLET | θF | ° | 104 | 76 |
| FLOW RATE OF AIR FOR CLASSIFICATION | | Qa | $m^3$/min | 2100 | 3000 |
| RATIO OF COLLECTION | CRUSH QUANTITY | Qf | t/h | 163 | 160 |
| ACCURACY IN CLASSIFICATION | SPECIFIC SURFACE AREA | Sp | $cm^2$/g | 3200 | 3200 |
| | 45 μm RESIDUE | R(45) | % | 8.2 | 9.0 |
| | 30 μm RESIDUE | R(30) | % | 20 | 22 |
| | RATIO OF DIVISION | β | % | 25 | 33 |
| | d25/d75 | K | — | 0.52 | 0.52 |

As seen from Table 3, the quantity of air used for classification was reduced by around 30%, compared with the same kind of classifier having conventional specifications, which was used as the subject, (it was 3000 $m^3$/min in the subject for comparison while it was 2100 $m^3$/min in the invention), but both of the accuracy in classification (the 30 μm residue, the 45 μm residue and the ratio of division β in this case) and the ratio of collection (the crush quantity in this case) were of better values than those of the subject for comparison, similarly to Embodiment 1. That is, both of the accuracy in classification and the ratio of collection were good in performance although the flow rate of the air for classification was decreased by 30% in the present invention.

EFFECT OF AN EMBODIMENT OF THE INVENTION

The following effects can be achieved when an embodiment of the present invention is applied to facilities such as a cement manufacturing plant since classification can be performed at the predetermined accuracy and ratio of collection with the minimum necessary flow rate of air for classification. It goes without saying that the air for classification includes gas other than air, as described above.

(1) Minimum and sufficient investment in plant and equipment is required (a main body of a classifier, a fan or a blower and a dust collector such as a bag filter).

(2) Minimum and sufficient running costs are required (decrease in expenses for necessary electric power in accordance with minimum and sufficient facilities and expenses for maintenance or exchange of expendables such as a bag filter cloth).

(3) Energy of natural resources can be saved and environmental loads can be decreased (reduction in size of facilities and decrease in consumption of necessary electric power energy in accordance with minimum and sufficient facilities).

The above description is considered that of the preferred embodiment(s) only. Modification of the invention will occur to those skilled in the art and to those who make or use the invention. Therefore, it is understood that the embodiment(s) shown in the drawings and described above are merely for illustrative purposes and not intended to limit the scope of the invention, which is defined by the following claims as interpreted according to the principles of patent law, including the doctrine of equivalents.

The invention claimed is:

1. A centrifugal air classifier comprising:

a rotor provided in a casing and including a dispersion plate and a rotational plate, the plates being fixed to a rotor rotational shaft with a space therebetween in an axial direction, and a plurality of rotor blades held between outer circumferential parts of the both plates;

guide vanes provided outside the rotor blades so as to be opposed to the rotor blades through a classification space;

an air inlet provided in the casing for supplying the classification space with air for classification through the guide vanes;

a powder inlet provided in an upper part of the casing so as to be faced to the dispersion plate; and a fine powder outlet for discharging a classified fine powder to an outside of the classifier;

wherein a relation between an area S1 of a side surface of a cylinder or a truncated cone circumscribed about the rotor blades, an axis of the cylinder or the truncated cone being the rotor rotational shaft, and a calculation average value D of a diameter of a circle orthogonal to the rotor rotational shaft and circumscribed about the rotor blades is $S1/D^2$=0.9 to 1.6.

2. The centrifugal air classifier according to claim 1, wherein:

$$S1/D^2=1.1 \text{ to } 1.5.$$

3. The centrifugal air classifier according to claim 2, wherein:

the powder inlet is provided in a place including the rotor rotational shaft.

4. The centrifugal air classifier according to claim 2, wherein:

the powder inlet is provided in a place not including the rotor rotational shaft and a sum θF of interior angles formed from two lines extending from the rotor rotational shaft so as to circumscribe about a horizontal cross section of the powder inlet and sandwiching the powder inlet, the two lines being vertical to the rotor rotational shaft, is 90°≦θF≦360°.

5. The centrifugal air classifier according to claim 2, wherein:

the air for classification flowing into the rotor through the classification space has a component of velocity in vertical direction of 12 m/s or more at a top of the rotor in flowing toward the fine powder outlet.

6. The centrifugal air classifier according to claim 5, wherein:

the component of velocity in vertical direction at the top of the rotor in flowing toward the fine powder outlet is 16 m/s to 22 m/s.

7. The centrifugal air classifier according to claim 5, wherein:

the powder inlet is provided in one place including the rotor rotational shaft.

8. The centrifugal air classifier according to claim 5, wherein:

a plural number of the powder inlets are provided in a place not including the rotor rotational shaft and a sum θF of interior angles formed from two lines extending from the rotor rotational shaft so as to circumscribe about a horizontal cross section of the powder inlet and sandwiching the powder inlet, the two lines being vertical to the rotor rotational shaft, is 90°≦θF≦360°.

9. The centrifugal air classifier according to claim 2, wherein:

the rotor blades are partitioned into a plurality of stories by means of horizontal annular partition plates and a tip end of the partition plate is located in a substantially same plane as a tip end of the rotor blades.

10. The centrifugal air classifier according to claim 9, wherein:

the tip end of the partition plate is projected by 0 to 7 mm from the tip end of the rotor blades.

11. The centrifugal air classifier according to claim 1, wherein:

the powder inlet is provided in a place including the rotor rotational shaft.

12. The centrifugal air classifier according to claim 1, wherein:

a plural number of powder inlets are provided in a place not including the rotor rotational shaft and a sum θF of interior angles formed from two lines extending from the rotor rotational shaft so as to circumscribe about a horizontal cross section of the powder inlet and sandwiching the powder inlet, the two lines being vertical to the rotor rotational shaft, is 90°≦θ*F*≦360°.

13. The centrifugal air classifier according to claim 1, wherein:

the air for classification flowing into the rotor through the classification space has a component of velocity in vertical direction of 12 m/s or more at a top of the rotor in flowing toward the fine powder outlet.

14. The centrifugal air classifier according to claim 13, wherein:

the component of velocity in vertical direction at the top of the rotor in flowing toward the fine powder outlet is 16 m/s to 22 m/s.

15. The centrifugal air classifier according to claim 13, wherein:

the powder inlet is provided in one place including the rotor rotational shaft.

16. The centrifugal air classifier according to claim 13, wherein:

a plural number of powder inlets are provided in a place not including the rotor rotational shaft and a sum θF of interior angles formed from two lines extending from the rotor rotational shaft so as to circumscribe about a horizontal cross section of the powder inlet and sandwiching the powder inlet, the two lines being vertical to the rotor rotational shaft, is 90°≦θF≦360°.

17. The centrifugal air classifier according to claim 1, wherein:

the rotor blades are partitioned into a plurality of stories by means of horizontal annular partition plates and a tip end of the partition plate is located in a substantially same plane as a tip end of the rotor blades.

18. The centrifugal air classifier according to claim 17, wherein:

the tip end of the partition plate is projected by 0 to 7 mm from the tip end of the rotor blades.

19. A centrifugal air classifier comprising:

a rotor provided in a casing and including a dispersion plate and a rotational plate, the plates being fixed to a rotor rotational shaft with a space therebetween in an axial direction, and a plurality of rotor blades held between outer circumferential parts of the both plates;

guide vanes provided outside the rotor blades so as to be opposed to the rotor blades through a classification space;

an air inlet provided in the casing for supplying the classification space with air for classification through the guide vanes;

a powder inlet provided in an upper part of the casing so as to be faced to the dispersion plate; and a fine powder outlet for discharging a classified fine powder to the outside of the classifier;

wherein a relation between a cross-sectional area S2 of inflow of the air for classification and a calculation average value D of the diameter of a circle orthogonal to the rotor rotational shaft and circumscribed about the rotor blades is $S2/D^2=0.8$ to 1.4.

20. The centrifugal air classifier according to claim 19, wherein:

$$S2/D^2=0.9 \text{ to } 1.3.$$

21. The centrifugal air classifier according to claim 20, wherein:

the powder inlet is provided in a place including the rotor rotational shaft.

22. The centrifugal air classifier according to claim 20, wherein:

the powder inlet is provided in a place not including the rotor rotational shaft and a sum θF of interior angles formed from two lines extending from the rotor rotational shaft so as to circumscribe about a horizontal cross section of the powder inlet and sandwiching the powder inlet, the two lines being vertical to the rotor rotational shaft, is 90°≦θF≦360°.

23. The centrifugal air classifier according to claim 20, wherein:

the air for classification flowing into the rotor through the classification space has a component of velocity in vertical direction of 12 m/s or more at a top of the rotor in flowing toward the fine powder outlet.

24. The centrifugal air classifier according to claim 23, wherein:

the component of velocity in vertical direction at the top of the rotor in flowing toward the fine powder outlet is 16 m/s to 22 m/s.

25. The centrifugal air classifier according to claim 23, wherein:

the powder inlet is provided in one place including the rotor rotational shaft.

26. The centrifugal air classifier according to claim 23, wherein:

a plural number of the powder inlets are provided in a place not including the rotor rotational shaft and a sum θF of interior angles formed from two lines extending from the rotor rotational shaft so as to circumscribe about a horizontal cross section of the powder inlet and sandwiching the powder inlet, the two lines being vertical to the rotor rotational shaft, is $90° \leqq \theta F \leqq 360°$.

27. The centrifugal air classifier according to claim 20, wherein:

the rotor blades are partitioned into a plurality of stories by means of horizontal annular partition plates and a tip end of the partition plate is located in a substantially same plane as a tip end of the rotor blades.

28. The centrifugal air classifier according to claim 27, wherein:

the tip end of the partition plate is projected by 0 to 7 mm from the tip end of the rotor blades.

29. The centrifugal air classifier according to claim 19, wherein:

the powder inlet is provided in a place including the rotor rotational shaft.

30. The centrifugal air classifier according to claim 19, wherein:

the powder inlet is provided in a place not including the rotor rotational shaft and a sum θF of interior angles formed from two lines extending from the rotor rotational shaft so as to circumscribe about a horizontal cross section of the powder inlet and sandwiching the powder inlet, the two lines being vertical to the rotor rotational shaft, is $90° \leqq \theta F \leqq 360°$.

31. The centrifugal air classifier according to claim 19, wherein:

the air for classification flowing into the rotor through the classification space has a component of velocity in vertical direction of 12 m/s or more at a top of the rotor in flowing toward the fine powder outlet.

32. The centrifugal air classifier according to claim 31, wherein:

the component of velocity in vertical direction at the top of the rotor in flowing toward the fine powder outlet is 16 m/s to 22 m/s.

33. The centrifugal air classifier according to claim 31, wherein:

the powder inlet is provided in one place including the rotor rotational shaft.

34. The centrifugal air classifier according to claim 31, wherein:

a plural number of the powder inlets are provided in a place not including the rotor rotational shaft and a sum θF of interior angles formed from two lines extending from the rotor rotational shaft so as to circumscribe about a horizontal cross section of the powder inlet and sandwiching the powder inlet, the two lines being vertical to the rotor rotational shaft, is $90° \leqq \theta F \leqq 360°$.

35. The centrifugal air classifier according to claim 19, wherein:

the rotor blades are partitioned into a plurality of stories by means of horizontal annular partition plates and a tip end of the partition plate is located in a substantially same plane as a tip end of the rotor blades.

36. The centrifugal air classifier according to claim 35, wherein:

the tip end of the partition plate is projected by 0 to 7 mm from the tip end of the rotor blades.

37. A centrifugal air classifier comprising:

a rotor provided in a casing and including a rotational plate and a dispersion plate, the plates being fixed to a rotor rotational shaft with a space therebetween, and a plurality of rotor blades held between outer circumferential parts of the both plates;

guide vanes provided outside the rotor blades so as to be opposed to the rotor blades through a classification space;

an air inlet provided in the casing for supplying the classification space with air for classification through the guide vanes;

a powder inlet provided in an upper part of the casing so as to be faced to the dispersion plate; and a fine powder outlet for discharging a classified fine powder to the outside of the classifier;

wherein a relation between an area S1 of a side surface of a cylinder or a truncated cone circumscribed about the rotor blades, an axis of the cylinder or the truncated cone being the rotor rotational shaft, and a calculation average value D of a diameter of a circle orthogonal to the rotor rotational shaft and circumscribed about the rotor blades is $S1/D^2=0.9$ to 1.6; and wherein a relation between a cross-sectional area S2 of inflow of the air for classification and the calculation average value D is $S2/D^2=0.8$ to 1.4.

38. The centrifugal air classifier according to claim 37, wherein:

$$S1/D^2=1.1 \text{ to } 1.5 \text{ and } S2/D^2=0.9 \text{ to } 1.3.$$

39. The centrifugal air classifier according to claim 37, wherein:

the powder inlet is provided in a place including the rotor rotational shaft.

40. The centrifugal air classifier according to claim 37, wherein:

the powder inlet is provided in a place not including the rotor rotational shaft and a sum θF of interior angles formed from two lines extending from the rotor rotational shaft so as to circumscribe about a horizontal cross section of the powder inlet and sandwiching the powder inlet, the two lines being vertical to the rotor rotational shaft, is $90° \leqq \theta F \leqq 360°$.

41. The centrifugal air classifier according to claim 37, wherein:

the air for classification flowing into the rotor through the classification space has a component of velocity in vertical direction of 12 m/s or more at a top of the rotor in flowing toward the fine powder outlet.

42. The centrifugal air classifier according to claim 41, wherein:

the component of velocity in vertical direction at the top of the rotor in flowing toward the fine powder outlet is 16 m/s to 22 m/s.

43. The centrifugal air classifier according to claim 41, wherein:

the powder inlet is provided in one place including the rotor rotational shaft.

44. The centrifugal air classifier according to claim 41, wherein:

a plural number of the powder inlets are provided in a place not including the rotor rotational shaft and a sum θF of interior angles formed from two lines extending from the rotor rotational shaft so as to circumscribe about a horizontal cross section of the powder inlet and sandwiching the powder inlet, the two lines being vertical to the rotor rotational shaft, is $90° \leqq \theta F \leqq 360°$.

45. The centrifugal air classifier according to claim 37, wherein:

the rotor blades are partitioned into a plurality of stories by means of horizontal annular partition plates and a tip end of the partition plate is located in a substantially same plane as a tip end of the rotor blades.

46. The centrifugal air classifier according to claim 45, wherein:

the tip end of the partition plate is projected by 0 to 7 mm from the tip end of the rotor blades.

* * * * *